US011266177B1

(12) United States Patent
Tebano

(10) Patent No.: US 11,266,177 B1
(45) Date of Patent: Mar. 8, 2022

(54) NATURAL WAX CIGARETTE FILTER

(71) Applicant: Attilio Tebano, Schenectady, NY (US)

(72) Inventor: Attilio Tebano, Schenectady, NY (US)

( * ) Notice: Subject to any disclaimer, the term of this patent is extended or adjusted under 35 U.S.C. 154(b) by 330 days.

(21) Appl. No.: 16/539,218

(22) Filed: Aug. 13, 2019

(51) Int. Cl.
*A24D 3/04* (2006.01)
*A24D 3/06* (2006.01)
*A24D 3/08* (2006.01)

(52) U.S. Cl.
CPC ..... *A24D 3/08* (2013.01); *A24D 3/043* (2013.01); *A24D 3/048* (2013.01); *A24D 3/068* (2013.01)

(58) Field of Classification Search
None
See application file for complete search history.

(56) References Cited

U.S. PATENT DOCUMENTS 3,040,752 A * 6/1962 Ganz ..... A24D 3/04 131/331
3,270,750 A 9/1966 Campbell
6,631,722 B2 10/2003 MacAdam et al.
7,325,548 B2 2/2008 Enslin
2015/0013693 A1* 1/2015 Fuisz ..... A24C 5/60 131/275

FOREIGN PATENT DOCUMENTS

EP 2856891 4/2015
JP H04207187 7/1997

* cited by examiner

*Primary Examiner* — Dennis R Cordray
(74) *Attorney, Agent, or Firm* — Sanchelima & Associates, P.A.; Christian Sanchelima; Jesus Sanchelima

(57) ABSTRACT

A filter (10) for cigarettes having a wax tubular member (20) with at least one through opening (30) to allow the smoke to pass through. A second detachable tubular member (125) can be optionally added. Through opening (30) may have different shapes that determine how much the smoke temperature is reduced. Member (20) can be selectively depressed to further constrain the passage of smoke to reduce the smoke temperature and trap more gunk. The present was filter is biodegradable and may be used as a carrier for seeds that may bloom when the filter is discarded.

9 Claims, 3 Drawing Sheets

NATURAL WAX CIGARETTE FILTER

BACKGROUND OF THE INVENTION

1. Field of the Invention

The present invention relates filters for cigarettes using any legal smoking herbs and, more particularly, to filters entirely made of wax for cigarettes.

2. Description of the Related Art

Many different filters for cigarettes have been designed in the past. None of them, however, include a filter made entirely out of wax to provide grip against a rolling paper/rolling leaf making it much easier for the consumer to roll. The present invention also allows the rolled cigarette to be stood upright using the wax filter to stick to a surface. The filter subject of the present invention extinguishes itself once the lit end of the cigarette reaches the wax filter and reduces the temperature of the smoke that passes through the filter. Additionally, the new filter provides a solid barrier/protection for any material (seeds, glitter, decoration) imbedded in the filter that would be discolored or damaged while smoking through the filter. Yet another feature of the invention is that the new filter moisturizes the smokers dry lips while smoking. Yet the new filter also allows for the selective constriction of the filter through passage changing the airflow of the smokers' pull and provides an ionization effect attracting and collecting the tar/resin emitted when smoking on to the end of the wax filter.

Applicant believes that a related reference corresponds to U.S. Pat. No. 6,631,722 issued to Mac Adam et al. for Tobacco Smoke Filter Elements on Oct. 14, 2003. However, it differs from the present invention because it is directed to a filter structure with a capsule containing a deodorizer. This capsule, however, does not allow the smoke to go therethrough. Additionally, there is no suggestion of using a wax filter, or a filter made entirely of wax.

Another related reference corresponds to U.S. Pat. No. 7,325,548 issued to George Frederick Enslin for Smoker's Requisite on Apr. 9, 2001. However, it differs from the present invention because it does not discuss a cigarette filter made entirely of wax.

Another related reference corresponds to U.S. Patent 20140332014 issued to Penrose, Graham on Nov. 13, 2014. However, it comprises of a recess to insert a filter unit attaching via small loops, hooks, or Velcro. With the present invention, no recessed hole or loops, hooks, or Velcro is needed for the wax filter to stay in place. Instead, the wax is naturally sticky and will stick to the rolling paper/leaf without the need of this.

Another related reference corresponds to U.S. Patent 20120318286 issued to Lisauskas, Tadas on Dec. 20, 2012. However, the present invention differs because wax protects seeds for the damage of smoke, unlike the cotton, hemp, paper barrier surrounding the seeds. In addition, wax is hydrogenated oil, which provides a more fertile environment for the seed to grow in once the filter is discarded and begins decomposing.

Another related reference corresponds to U.S. Pat. No. 3,270,750A issued to Robert A Campbell on Sep. 16, 1960. However, the present invention differs because there is no mention of the filter being made of wax. A filter made of wax allows the apparatus of the filter to be expanded or constricted at any time of the smoking process. Additionally, there is no mention of the filter being made of wax.

Another related reference corresponds to JP Patent H04207187 issued to KANEMATSU NOBORU on Jul. 29, 1997. However, the present invention differs because our filter is made entirely of beeswax, as opposed to the polypropylene fiber obtained once adding wood wax or beeswax in the referenced invention. By making the filter entirely out of beeswax allows it to collect substantial more wax and resin.

Another related reference corresponds to EP 2856891 issued to KATO KATSUO, et al on Apr. 8, 2015. However, the present invention differs because wax is mentioned as a gap filling layer of the cigarette. Instead, the present invention is made entirely out of wax.

Wax has ionization like effect causing the tar (gunk) to adhere to the inner surfaces of the through holes. This is particularly true with the respect to the area abutting smokable material or herbs being smoked.

Wax acts as a lip moisturizer. Paper and/or cotton filters, on the other hand, tend to dry a user's lips and fingertips. None of the know art addresses this problem.

It is not uncommon to see cigarette butts, including filters, polluting urban areas. The present invention's wax filter, in addition to the properties described below that enhance a smoking experience, provides a carrier for seeds that will embellish the environment. When a user discards his or her cigarette butt, the seeds germinate after being encapsulated by the wax filter. This is a novel concept that will reduce pollution while enhancing the environment.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a filter for cigarettes made out of wax, including natural wax, that moisturizes the lips and fingertips of the smoker while smoking.

It is another main object of the invention to provide a better grip when rolling one's own cigarettes using the wax filter. The wax filter sticks to rolling papers/rolling materials much better than existing paper or cotton filters.

It is another object of this invention to provide an extinguishable filter made entirely of wax that will put out the lit side of the cigarette once it reaches the wax filter.

It is another object of the present invention to provide a solid barrier that lowers the temperature of the smoke passing there through.

It is another object of the present invention to provide smokers with a means to stand their cigarette upright while not in the presence of an ashtray by adhering the wax filter's base to a surface.

It is another object of this invention to provide a filter that is non-flammable. Still another object of the invention is to provide a filter that is biodegradable and can act as a carrier for seeds of predetermined species.

Yet another object of the invention is to provide a filter with through holes having adjustable diameters to control the temperature.

It is still another object of the present invention to provide a filter that absorbs or neutralizes the odor of the smokable material or herb smoke passing through.

It is yet another object of this invention to provide such a filter that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
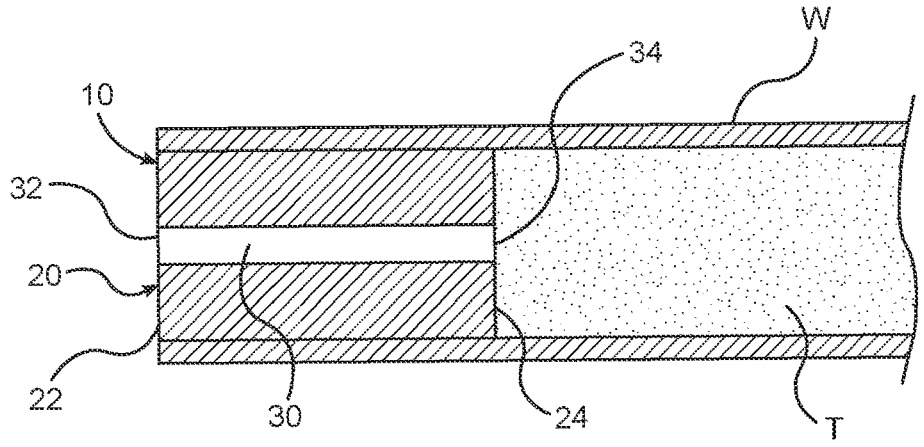
FIG. 1 represents a cross-sectioned view of one of the embodiments of the present invention showing uniform through hole 30 passing through filter 10.

Referring now to the drawings, where different embodiments of the present invention are shown. One of the Filter embodiments is generally referred to with 10, and it can be observed that it basically includes tubular member 20 with ends 22 and 24. Longitudinally extending through hole 30 extends from end 22 to end 24. Through hole 30 includes through hole ends 32; 34. End 22 is mounted axially with respect to cigarette C and in abutting relationship with one of its ends. The other end 24 constitutes the distal end of filter 10. Wrapper W or paper P is used to roll herbs or smokable material T.

Tubular member 20 is made out of wax, and preferably natural wax.

Figure 2:
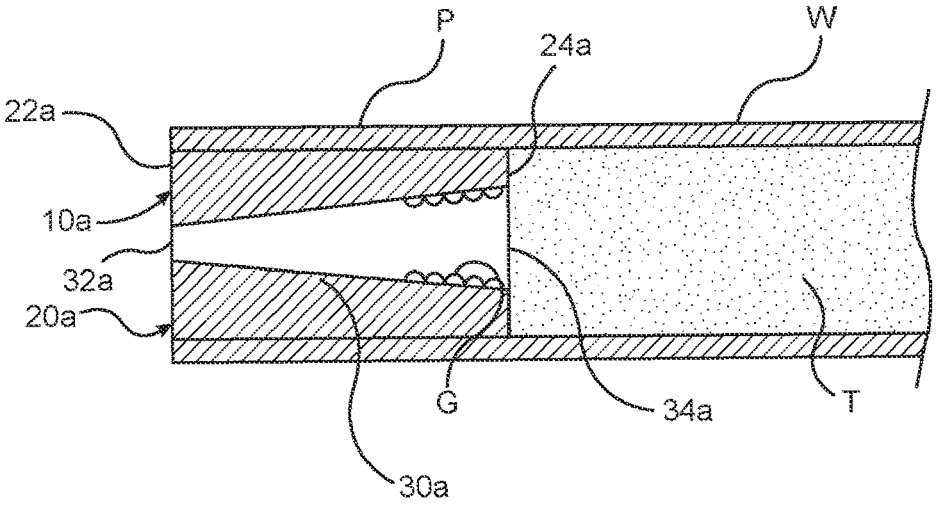
FIG. 2 shows a cross-sectional view of an alternate embodiment wherein filter 10*a* has a frusto-conical shape.
Figure 3:
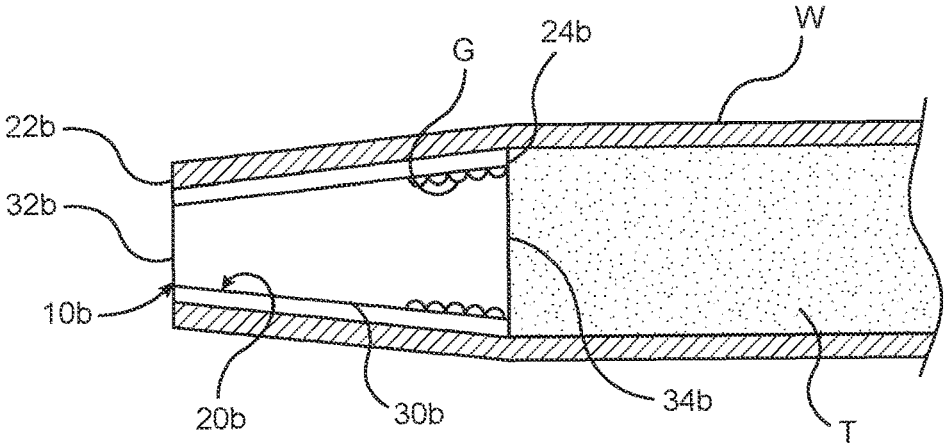
FIG. 3 shows a cross-sectional view of another embodiment of filter 10*b* with through hole 30*b* having a frusto-conical shape with large diameters that the one represented in the previous figure.
Figure 4:
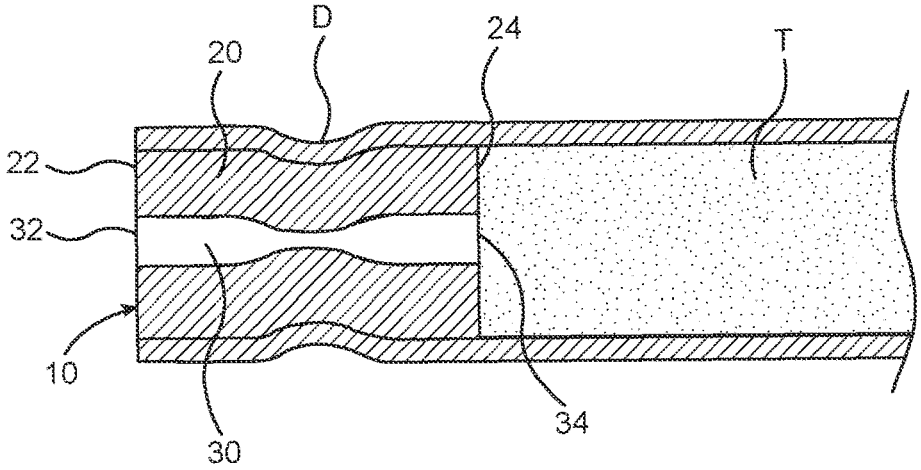
FIG. 4 shows filter 10 represented in FIG. 1 with a depression D typically created by a user who want to lower the temperature of the smoke.
Figure 5:
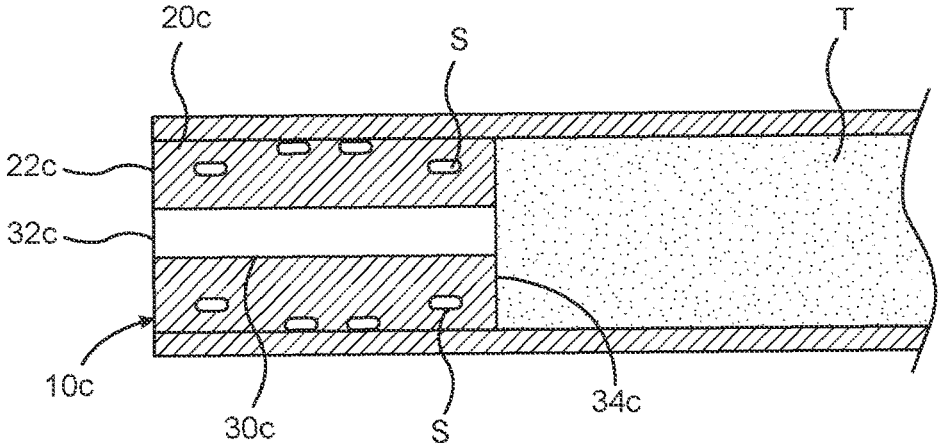
FIG. 5 shows filter 10*c* which is similar to filter 10 represented in FIG. 1 with seeds S buried in tubular member 20.
Figure 6:
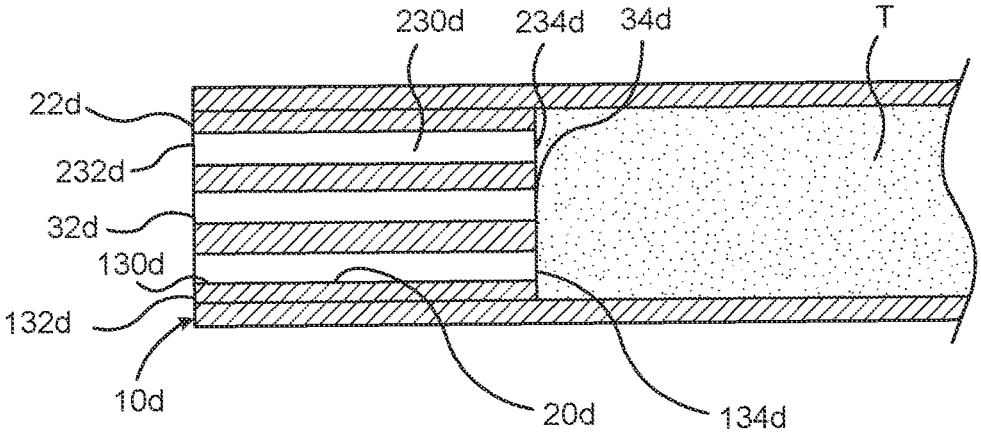
FIG. 6 is similar to FIG. 1 except that more than one through hole are shown.

The different filter configurations provide different smoking experiences. In FIG. 1, through hole 30 is shown to be centrally located with a uniform internal diameter and in FIG. 2, through hole 30*a* has a frustoconical shape. Through hole 30*a* includes through hole ends 32*a* and 34*a*. Filter 10*a* includes tubular member 20*a* with ends 22*a* and 24*a*. FIG. 3 is similar to FIG. 2 except that through hole 30*b* has larger diameters along its length. Gunk G is shown in this figure only but it attaches to the internal walls of through hole 30 in the other filter configurations also. Through hole 30*b* includes through hole ends 32*b* and 34*b*. Filter 10*b* includes tubular member 20*b* with ends 22*b* and 24*b*. In FIG. 4, filter 10 is shown with a depression area where a user can selectively apply pressure reducing the diameter of through hole 30. This allows the user to constrain the passage of the smoke thereby reducing its temperature and tar content. The smoke speed and pressure against the internal walls of through hole 30 are increased facilitating the conduction of heat away from the smoke and attaching more tar. In FIG. 5 seeds S have been buried inside tubular member 20*c* of biodegradable filter 10*c*. Tubular member 20*c* includes distal end 22*c*. Through hole 30*c* in FIG. 5 includes though hole ends 32*c* and 34*c*. As it can be seen from FIG. 6, filter 10*d* may include one or more through holes 30*d*. Tubular member 20*d* has distal end 22*d*. Through holes 30*d*; 130*d* and 230*d*, in FIG. 6, have through hole ends 32*d* and 34*d*; 132*d* and 134*d*. 232*d* and 234*d*, respectively.

As mentioned above, a wax filter facilitates rolling the material to be smoked and it also permits a user to set the cigarette against a surface. End 22 of tubular member 20 sticks to a supporting surface keeping it in an upright position.

And with respect to preserving objects inside filter 10, the inert characteristics of wax prevents the spoilage of seeds S that may be inserted therein.

Figure 7:
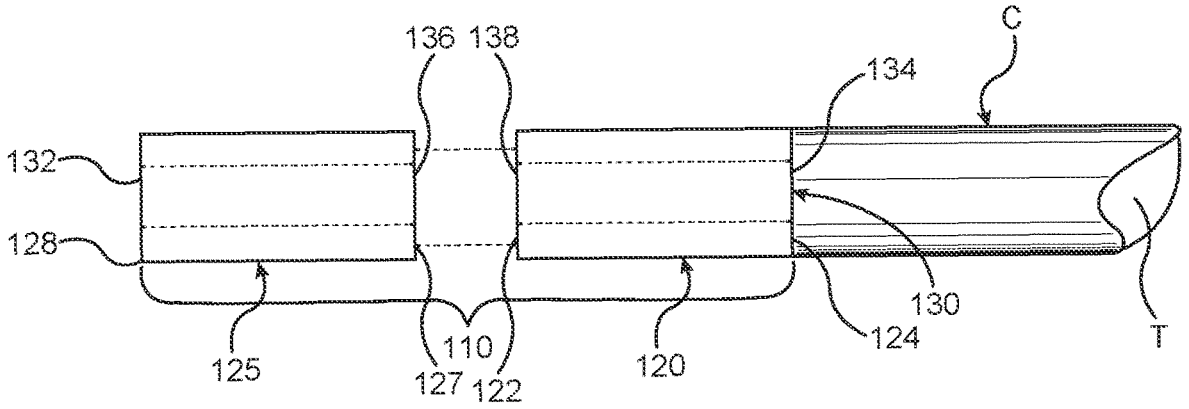
FIG. 7 shows an alternate embodiment for a cigarette filter 110 with two filter tubular members 120 and 125 with cooperative dimensions to be coaxially mounted to each other.
Figure 8:
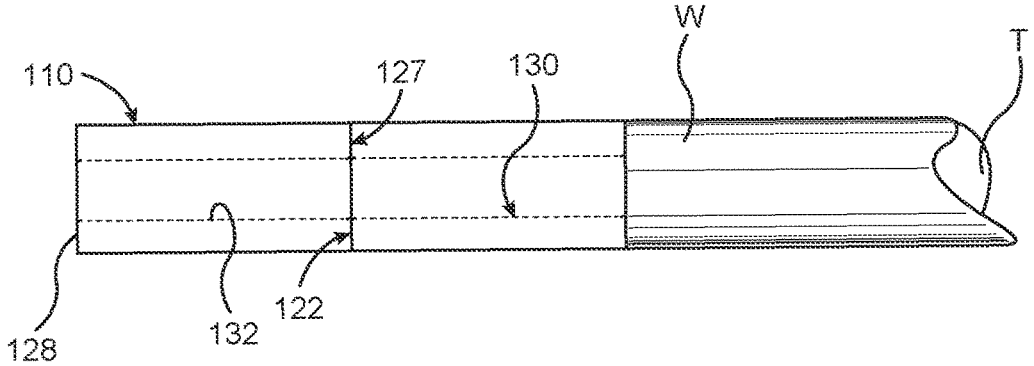
FIG. 8 shows the cigarette filter 110 represented in the previous figure where filter tubular members 120 and 125 have been coaxially mounted to permit a second user to smoke the same cigarette without coining in contact with tubular member 120 used by the original user.
Figure 9:
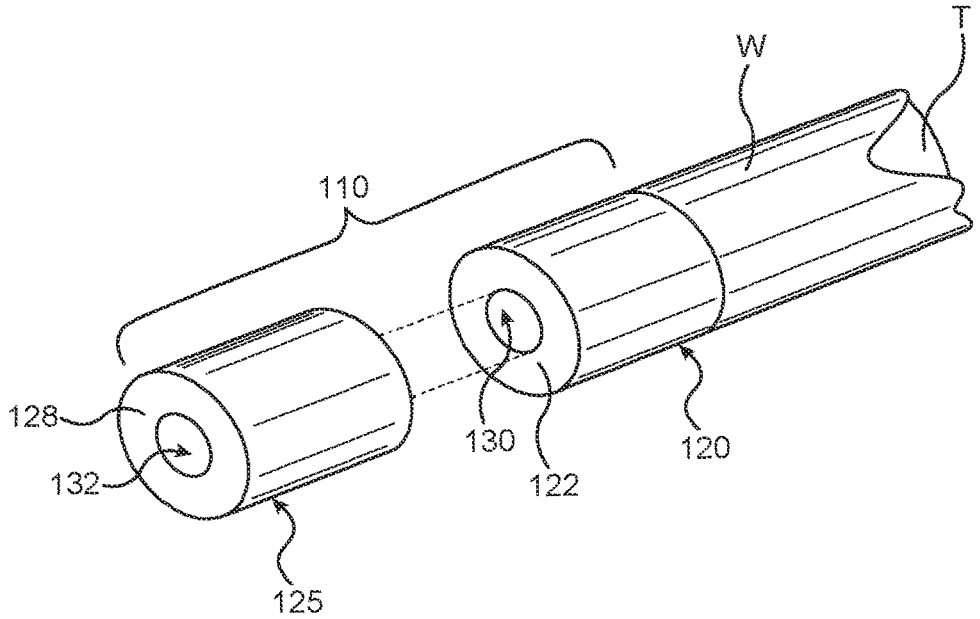
FIG. 9 is an isometric representation of the cigarette filter 110 shown in FIG. 7.

As seen in FIGS. 7 through 9, an alternate embodiment corresponds to a cigarette filter 110 that includes tubular members 120 and 125 that in turn can be detached and attached to permit two users to share the smoking experience while avoiding contact with areas of the tubular members where the other user has had contact. Tubular member 120 has ends 122 and 124. Tubular member 125 has ends 127 and 128. Tubular members 120 and 125 have cooperative dimensions that permit a substantial coaxial alignment. The ends 122 and 127 are brought together and attach to each other resulting in a sufficiently tight seal to permit the second user (using tubular member 125) to draw the smoke substantially in the same fashion as the initial user using tubular member 120. Through hole 130 extends through tubular members 120 and 125 to coaxially align with through hole 132. Through hole end 134 comes in an abutting coaxial relationship with cigarette C. Through hole ends 136 and 138 are detachable and coaxially mounted to each other.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A filter for cigarettes, comprising:

A) a tubular member (20) made out of wax having first and second ends (22), (24), and further including a through hole (30) extending from said first end (22) to said second end (24);

B) a wrap member (W) covering said tubular member (20) and extending coaxially beyond said end (24) a predetermined distance and containing a smokable herb therein.

2. The filter set forth in claim 1 where the wax is natural.

3. The filter set forth in claim 2 wherein said tubular member (20) includes a plurality of through holes (30).

4. The filter set forth in claim 2 wherein said through is centrally located.

5. The filter set forth in claim 4 wherein said tubular member (20) has a circular cross-section.

6. The filter set forth in claim 4 wherein said through hole (30) has a frustoconical shape with first and second through hole ends, said first through hole end being larger than said second through hole end, the former extending from said second end (24) adjacent to said smokable herb.

7. The filter set forth in claim 4 further including at least one seed (S) contained inside said filter member (20).

8. A filter for cigarettes, comprising:

A) a first tubular member (120) made out of wax having first and second ends (122), (124), and further including a through hole (130) extending from said first end (122) to said second end (124);

B) a second tubular member (125) made out of wax having third and fourth ends (127), (128), and further including a through opening (131) extending from said third end (127) to said fourth end (128), said first and third ends (122), (127) having cooperative dimensions to come in an abutment relationship to provide a sufficient seal to permit a user to draw smoke when applying his/her lips to said second tubular member (125); and C) a wrap member (W) covering said tubular member (120) and extending coaxially beyond said second end (124) a predetermined distance and containing a smokable herb therein and adjacent to said second end (124).

9. The filter set forth in claim 8 wherein the wax is natural.

* * * * *